US005456584A

United States Patent [19]

Isomura et al.

[11] Patent Number: 5,456,584

[45] Date of Patent: Oct. 10, 1995

[54] SCROLL TYPE COMPRESSOR WITH REFRIGERANT GAS PASSAGE IN BALANCE WEIGHT

[75] Inventors: Kenji Isomura; Tetsuhiko Fukanuma; Shinsuke Asou; Kunifumi Goto; Shigeru Hisanaga, all of Kariya; Tsuyoshi Takemoto, Aichi; Yuuji Yamamoto, Toyota, all of Japan

[73] Assignees: Kabushiki Kaisha Toyoda Jidoshokki Seisakusho; Nippondenso Co., Ltd., both of Kariya, Japan

[21] Appl. No.: 328,728

[22] Filed: Oct. 25, 1994

[30] Foreign Application Priority Data

Oct. 29, 1993 [JP] Japan ..... 5-272409

[51] Int. Cl.[6] ..... F01C 1/04; F01C 21/04

[52] U.S. Cl. ..... 418/55.1; 418/94; 418/151

[58] Field of Search ..... 418/55.1, 91, 94, 418/100, 102, 151

[56] References Cited

U.S. PATENT DOCUMENTS 5,201,646 4/1993 Dees et al. ..... 418/100
5,308,231 5/1994 Bookbinder et al. ..... 418/94

FOREIGN PATENT DOCUMENTS 491294 8/1992 Japan .
5302578 11/1993 Japan ..... 418/55.1

*Primary Examiner*—Richard A. Bertsch
*Assistant Examiner*—Charles G. Freay
*Attorney, Agent, or Firm*—Brooks Haidt Haffner & Delahunty

[57] ABSTRACT

When a rotary shaft of a scroll type compressor rotates and a movable scroll of the compressor makes an orbital movement around the axis of a rotary shaft by way of an eccentric shaft, refrigerant gas is supplied to compression chambers between a fixed scroll and the movable scroll. A first bearing rotatably supports the rotary shaft. A second bearing is provided between the movable scroll and the eccentric shaft to permit relative movement therebetween. A balance weight attached to the movable scroll dynamically balances the movable scroll during its rotation. A crank chamber accommodates the balance weight. A suction port is so provided in the housing as to communicate with the crank chamber, and permits the refrigerant gas to be supplied into the housing. A passage is formed in the balance weight, the eccentric shaft and the rotary shaft to supply the refrigerant gas into a first gap between the first bearing and the rotary shaft and a second gap between the second bearing and the movable scroll.

15 Claims, 8 Drawing Sheets

SCROLL TYPE COMPRESSOR WITH REFRIGERANT GAS PASSAGE IN BALANCE WEIGHT

BACKGROUND OF THE INVENTION

1. Field of the Invention

The present invention in general relates to a scroll type compressor, and in particular, to a scroll type compressor used, for example, in an air conditioning system of a vehicle.

2. Description of the Related Art

Generally speaking, a conventional scroll type compressor comprises a fixed and a movable spiral element mounted on respective base plates and disposed inside a compressor housing. Contacting sidewall portions of scroll elements form compression chambers between the spiral elements in which refrigerant gas is compressed. During the compressor's operation, an eccentric shaft coupled to a rotary shaft causes the movable scroll to orbit in a circular locus, while anti-rotation devices prevent the movable scroll from rotating around its own axis. A suction chamber, defined between the inner wall of the housing and the spiral elements, supplies refrigerant gas to the compression chambers. As each compression chamber moves toward the inner tip portions of the spiral elements from the outer tip portions, the volume of the compression chamber decreases, compressing the refrigerant gas inside the compression chamber. The compressed refrigerant gas is then discharged into a discharge chamber in the housing via a discharge port formed in the center portion of the end plate of the fixed scroll.

Japanese Unexamined Utility Model Publication No. 4-91294 discloses a conventional scroll type compressor. This compressor, as illustrated in FIG. 10, uses a balance weight 50, attached to an eccentric shaft 52 and disposed in a crank chamber 53, to counter the dynamically unbalanced rotation of the movable scroll 51. This design prevents abnormal levels of compressor vibration.

A bushing 54, movably fitted in a boss 55 via a radial bearing 56, fits onto the eccentric shaft 52. The boss 55 is formed on the end plate of the movable scroll 51. A narrow gap 57, between the inner wall of the boss 55 and the bushing 54 communicates with the crank chamber 53 via a passage 58 formed in the bushing 54 and the balance weight 50.

A suction port (not shown), provided in the center portion of the outer surface of the compressor housing, supplies refrigerant gas from a circuit outside the compressor to the suction chamber formed between the housing and the movable scroll 51. The crank chamber communicates with the suction chamber via a gap formed in the anti-rotation devices.

Consequently, the supply of lubricating oil to the radial bearing 56, according to conventional compressor design, must pass from the suction port to the suction chamber and crank chamber. This requirement reduces the amount of lubricating oil supplied to the radial bearing 56, and effectively limits the serviceability and durability of the bearing 56 as well as that of the compressor.

Much the same is true with respect to yet another bearing, located proximate to the crank chamber between the rotary shaft and compressor housing. This rotary bearing supports the rotary shaft at the location where the rotary shaft extends to the exterior of the compressor. A seal, provided between the rotary bearing and exterior, prevents refrigerant gas and oil leakage from the crank chamber to the exterior of the compressor. Inherent to the rotary bearing's design is a gap which extends through the bearing, to the rotary shaft via a clearance between the rotary bearing and seal. This gap allows oil to be supplied from the crank chamber to the rotary shaft and seal in order to prevent premature wearing of the seal.

As in the case of the radial bearing 56, the rotary shaft bearing receives a supply of lubricating oil that must pass from the suction port to the suction chamber and crank chamber. This requirement effectively reduces the amount of oil supplied not only to the radial bearing, but also to the rotary shaft and seal. This limits the serviceability and durability of the seal, rotary bearing and the compressor.

SUMMARY OF THE INVENTION

It is therefore a primary objective of the present invention to provide a scroll type compressor which can increase the amount of oil supplied to the bearings supporting the rotary shaft and movable scroll, thereby improving their serviceability and durability.

To achieve the foregoing and other objects and in accordance with the purpose of the present invention, a scroll type compressor embodying the present invention comprises a fixed and a movable scroll provided in a housing. The movable scroll coupled to a rotary shaft via an eccentric shaft in the housing, is engaged with the fixed scroll so as to provide compression chambers between both scrolls. The rotation of the movable scroll around the axis of the rotary shaft is hindered, when the movable scroll makes an orbital movement around the axis of the rotary shaft. The movable scroll's movement causes refrigerant gas to flow into the compression chambers where it is compressed. A first bearing rotatably supports the rotary shaft. A second bearing is provided between the movable scroll and the eccentric shaft to permit relative movement therebetween. A balance weight, coupled to the movable scroll, maintains the dynamic balance of the orbiting movable scroll. A crank chamber provided in the housing accommodates the balance weight. A suction port, provided in the housing, allows a supply of external refrigerant gas to communicate with the crank chamber in the housing. A passage capable of supplying the refrigerant gas to a first gap between the first bearing and the rotary shaft, and a second gap between the second bearing and the movable scroll is formed in the balance weight, the eccentric shaft and the rotary shaft.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

Figure 1:
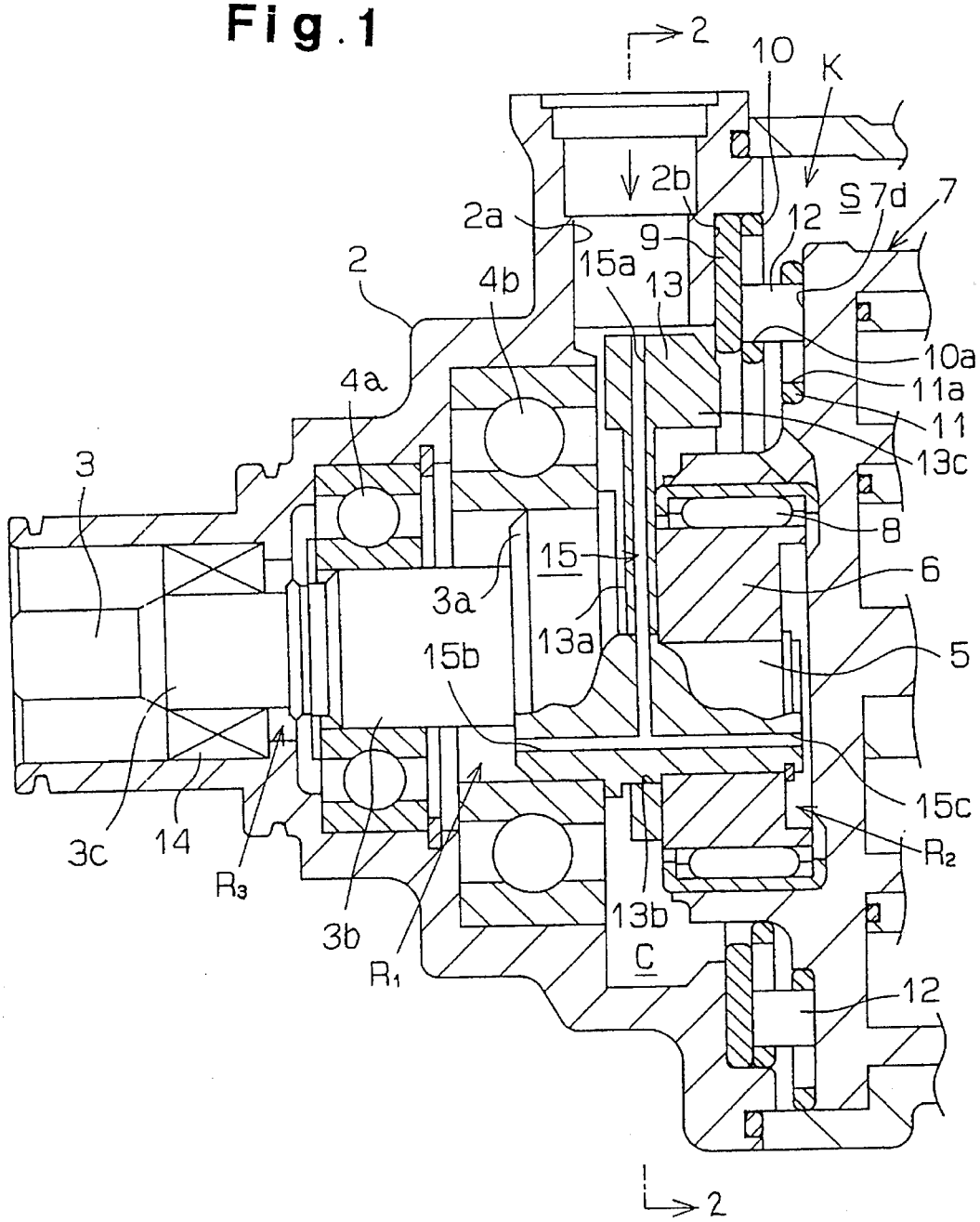
FIG. 1 is a cross-sectional view showing a part of a scroll type compressor according to one embodiment of the present invention.

A scroll type compressor according to one embodiment of the present invention as adapted for use in a vehicular air conditioning system will now be described with reference to FIGS. 1 through 4. As shown in FIG. 3, a front housing 2 having a suction port 2*a* is secured to a fixed scroll 1, which constitutes a center housing 1*d*. The fixed scroll 1 has an end plate 1*a* and a spiral element 1*b* integrally formed with the end plate 1*a*. A rotary shaft 3, which has a large-diameter portion 3*a*, an intermediate-diameter portion 3*b* and a small-diameter portion 3*c*, is rotatably supported in the front housing 2 via a pair of bearings 4*a* and 4*b* of different diameters. An eccentric square column shaft 5 is secured to the large-diameter portion 3*a* of the rotary shaft 3. This eccentric shaft 5 revolves around the axis of the rotary shaft 3 as the rotary shaft 3 rotates.

A bushing 6 is supported on the eccentric shaft 5. A movable scroll 7 has an end plate 7*a* and a spiral element 7*b* similar to the fixed scroll. Formed in the front face of the end plate 7*a* is a boss 7*c* in which bushing 6 is fitted via a radial bearing 8. The movable spiral element 7*b* engages the fixed spiral element 1*b*, forming a plurality of compression chambers P therebetween.

A movable pressure receiving wall 7*d* is provided on the front face of the movable end plate 7*a*, and a fixed pressure receiving wall 2*b* is provided on the inner surface of the front housing 2. An anti-rotation mechanism K intervenes between the pressure receiving walls 7*d* and 2*b* in order to inhibit the rotation of the movable scroll 7 around the rotary shaft 3 to permit the orbital movement of the movable scroll 7 around the rotary shaft 3. This anti-rotation mechanism K has a fixed race 9 fixed to the fixed pressure receiving wall 2*b* and a ring 10 secured to this race 9. The fixed ring 10 has a plurality of circular holes (four holes in this embodiment) 10*a* for limiting the range of the orbital movement of the movable scroll 7. A movable ring 11 is secured to the movable pressure receiving wall 7*d*, and has a plurality of holes 11*a* formed therein that face the fixed ring 10. Cylindrical pins 12 are loosely fitted in both holes 10*a* and 11*a* to prevent the rotation of the movable scroll 7 around its own axis. When refrigerant gas is compressed in the compression chambers, each pin 12 transmits the pressure acting on the movable end plate 7*a* to the fixed pressure receiving wall 2*b* from the movable pressure receiving wall 7*d*.

Figure 3:
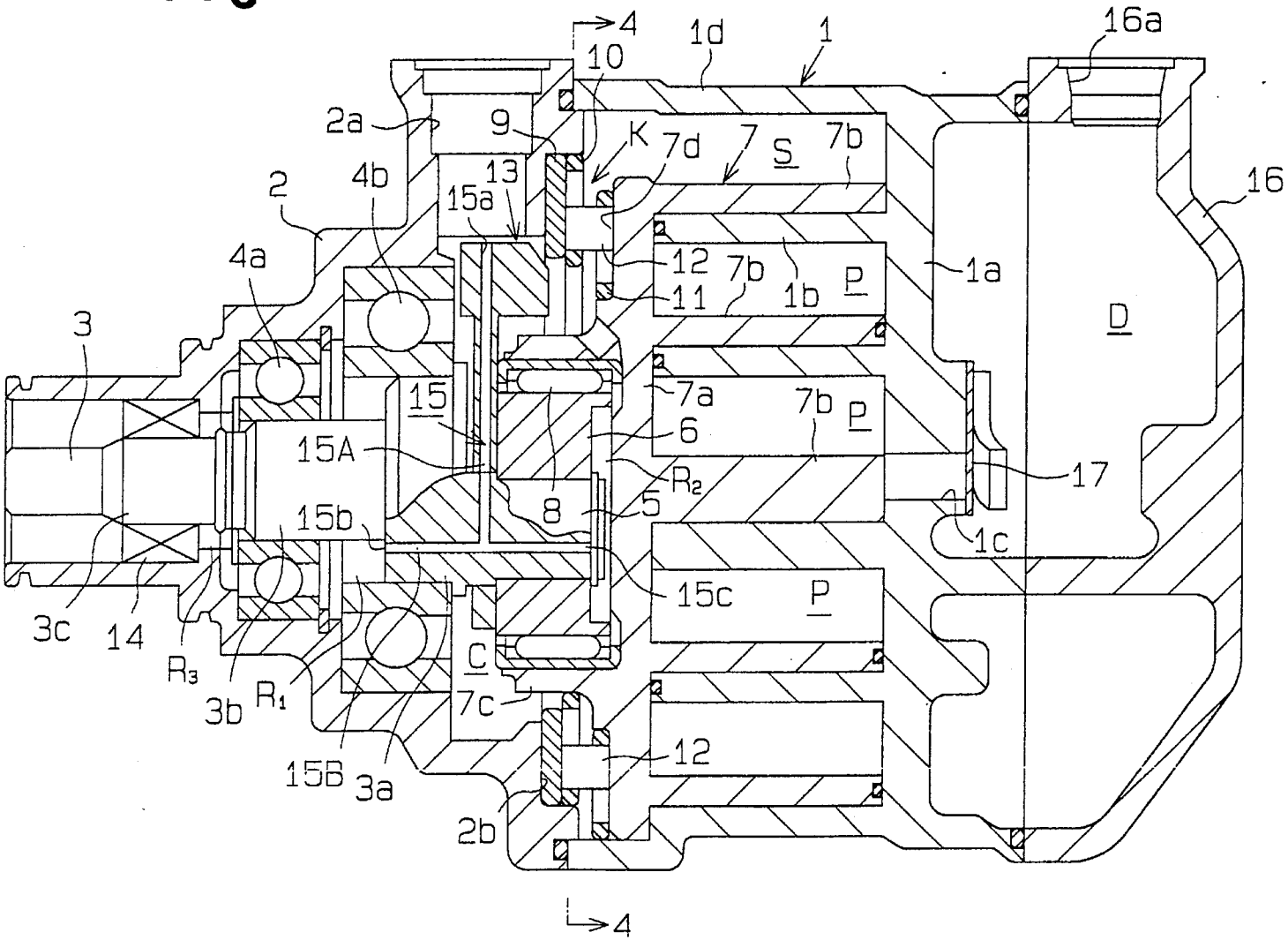
FIG. 3 is a reduced cross-sectional view showing the whole compressor in FIG. 1.
Figure 4:
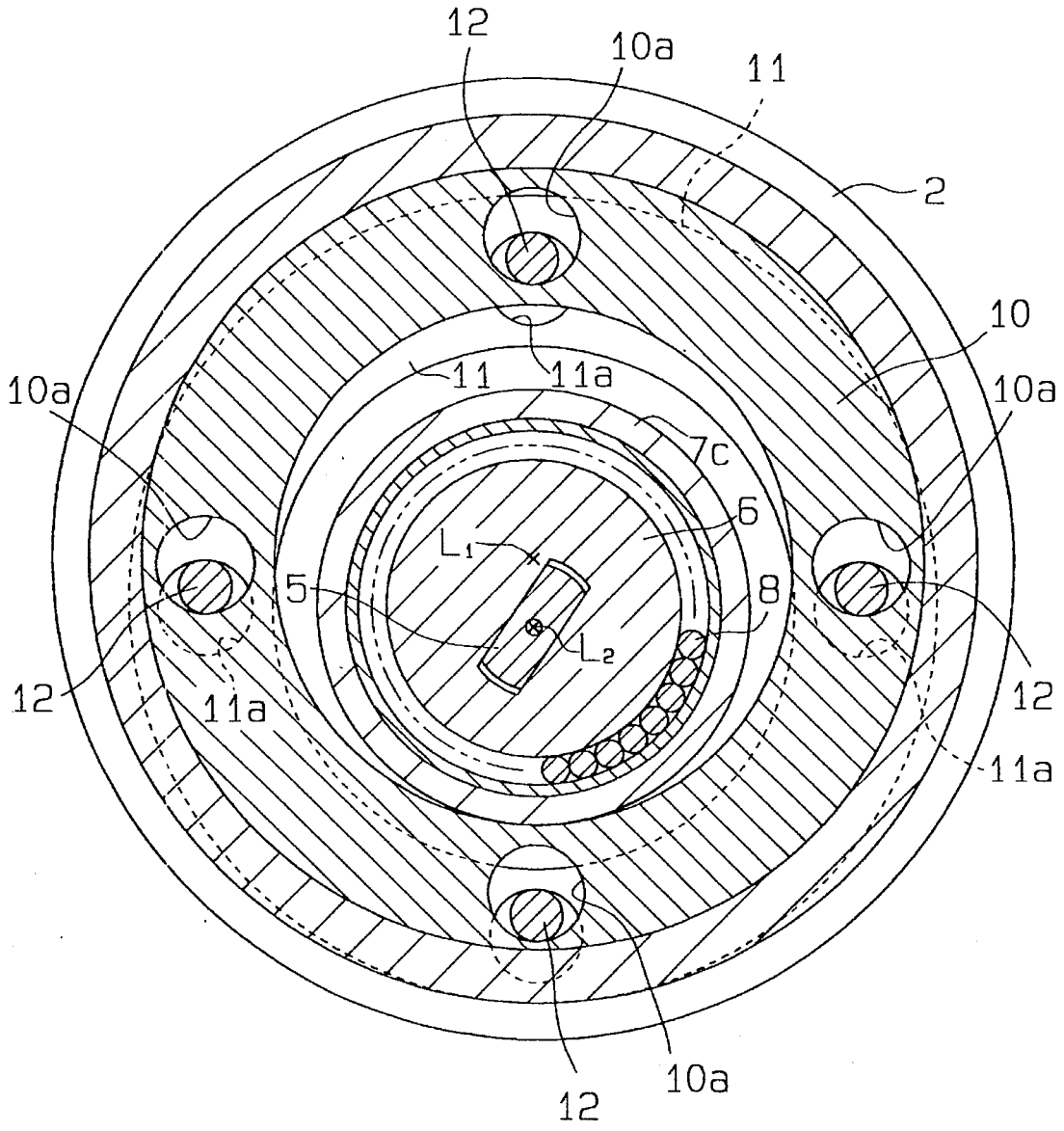
FIG. 4 is a cross-sectional view taken along the line 4—4 in FIG. 3.

When the rotary shaft 3 shown in FIGS. 3 and 4 rotates, the eccentric shaft 5 revolves around the center axis, $L_1$, of the rotary shaft 3 with a predetermined radius of orbital movement. The movable scroll 7 revolves via the bushing 6 and the bearing 8. FIG. 4 shows the eccentric shaft 5 and movable scroll 7 at the lowest position in the range of the orbital movement of the movable scroll 7. At this position, the topmost portion of each hole 11*a* of the movable ring 11 is in contact with the associated pin 12. This pin 12 is also in contact with the lowest portion of the associated hole 10*a* of the fixed ring 10.

When the rotary shaft rotates the eccentric shaft 180 degrees clockwise, for example, the pin 12 rolls in the associated hole 10*a* and reaches the uppermost portion. During this movement, the movable ring 11 follows up the pins 12 and moves upward in an orbital locus. The movable scroll 7 therefore rotates at a predetermined radius around the axis of the rotary shaft, and yet is prevented from rotating around its own axis. The radius of orbital movement is equivalent to the distance between the axis $L_1$ of the rotary shaft 3 and the axis, $L_2$, of the eccentric shaft 5.

Figure 2:
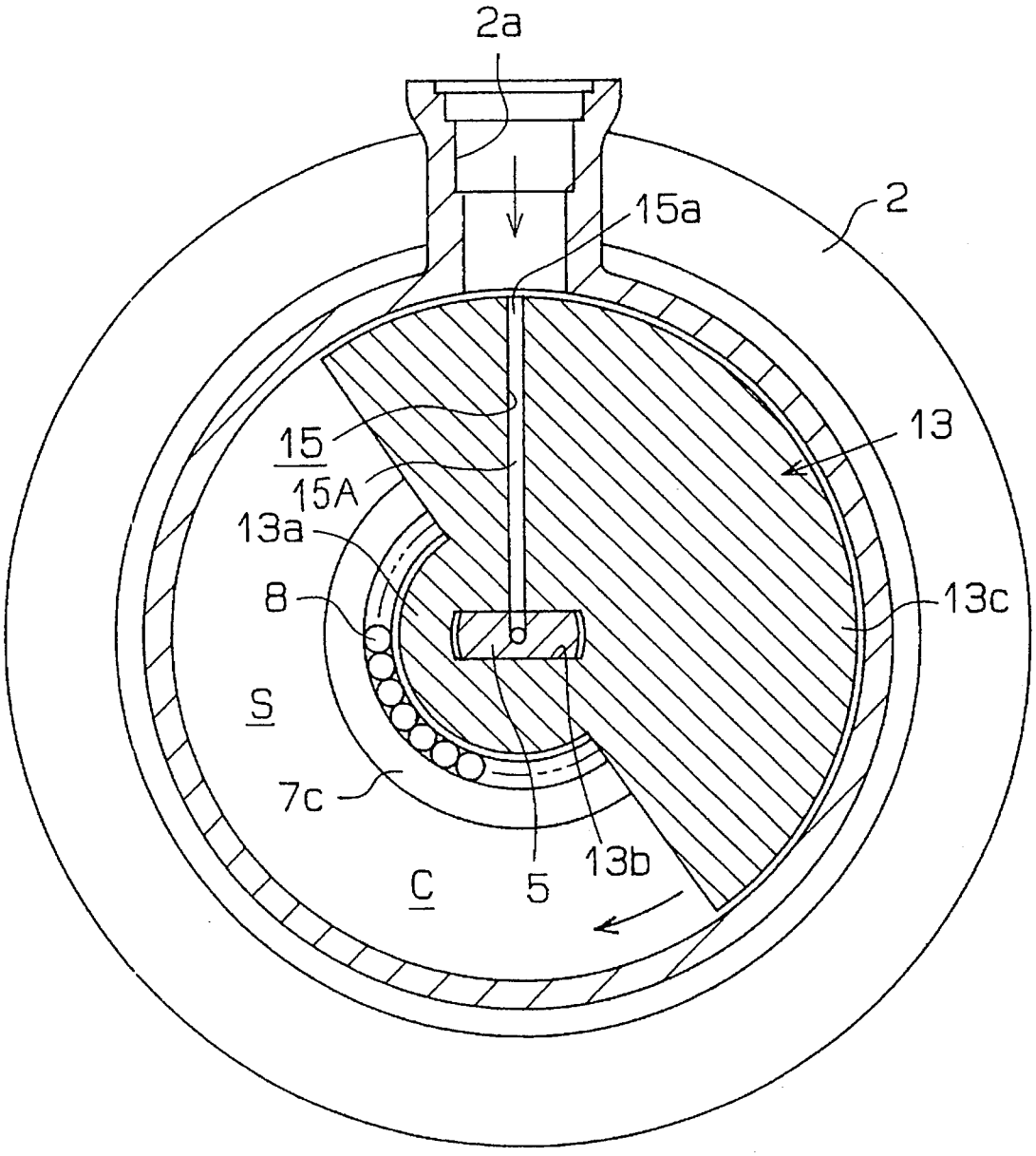
FIG. 2 is a cross-sectional view taken along the line 2—2 in FIG. 1.

As shown in FIGS. 1 through 3, a balance weight 13 is attached to the eccentric shaft 5 to compensate for the dynamically unbalanced rotation of the movable scroll 7. This prevents the compressor from experiencing any abnormal level of vibration. The balance weight 13 has a flat portion 13*a*, formed with an elongated rectangular shape hole 13*b*, through which the eccentric shaft 5 is inserted. A semicircular extending portion 13*c* is formed on the outer surface of the flat portion 13*a*. The aforementioned suction port 2*a* is located in the top of the front housing 2 in proximity to the orbital locus of the balance weight 13. The balance weight 13 is accommodated in a crank chamber C formed in the front housing 2.

A first gap $R_1$ shown in FIG. 1 is formed between the pair of bearings 4*a* and 4*b*, and a second gap $R_2$ between the inner bottom of the boss 7*c* of the movable scroll 7 and the bushing 6. A gas supply passage 15 is formed in the balance weight 13, the rotary shaft 3 and the eccentric shaft 5 to guide part of the refrigerant gas, supplied to the crank chamber C via the suction port 2*a*, to the first and second gaps $R_1$ and $R_2$. This passage 15 has a first portion 15A extending in the radial direction of the balance weight 13 and a second portion 15B extending along the axis of the rotary shaft 3. The second portion 15B penetrates the large-diameter portion 3*a* of the rotary shaft 3 and the eccentric shaft 5. The gas supply passage 15 has an inlet port 15*a* formed in the first portion 15A, open to the outer peripheral surface of the extending portion 13*c* of the balance weight 13. Two outlet ports 15*b* and 15*c* are provided on both ends of the second portion 15B open to the first and second gaps $R_1$ and $R_2$, respectively. The refrigerant gas containing the lubricating oil mist can therefore be supplied to the gaps $R_1$ and $R_2$ via the gas supply passage 15. A sealed chamber (third gap) $R_3$ is provided between the bearing 4*a* and a seal 14.

As shown in FIG. 3, a suction chamber S, formed between the center housing 1*d* and both spiral elements 1*b* and 7*b*, communicates the crank chamber C and the suction port 2*a* via the gap in the anti-rotation mechanism K. A rear housing 16 is secured to the back of the fixed scroll 1, with a discharge chamber D formed inside the housing 16. A discharge port 1*c* is formed in the fixed end plate 1*a*, while a discharge valve 17 that opens and closes this discharge port 1*c* is provided in the discharge chamber D. An outlet port 16*a* is formed in the rear housing 16.

According to the above-described scroll type compressor, when a vehicle engine's power is transmitted to and rotates the rotary shaft 3, the eccentric shaft 5 revolves causing the movable scroll 7 to revolve around the rotary shaft 3. The movable scroll 7 undergoes this movement without rotating around its own axis due to the anti-rotation mechanism K. The refrigerant gas, supplied to the crank chamber C through the suction port 2*a*, flows into the suction chamber S via the gap in the anti-rotation mechanism K. Thereafter, the refrigerant gas is supplied into the compression chambers P between both scrolls 1 and 7. As the movable scroll 7 revolves, the compression chambers P move toward the centers of the spiral elements 1*b* and 7*b*. During that period, the volume of the individual chambers decrease, compressing the refrigerant gas in each chamber. This compressed refrigerant gas is then discharged into the discharge chamber D through the discharge port 1*c* in the fixed end plate 1*a*.

As mentioned above, the gas supply passage 15 is formed in the balance weight 13, the rotary shaft 3 and the eccentric shaft 5 in this embodiment. When the balance weight 13 revolves and the inlet port 15*a* of this passage 15 comes to face the suction port 2*a*, the refrigerant gas enters the passage 15 from the inlet port 15*a*. This gas is supplied to the first and second gaps $R_1$ and $R_2$ via the respective output ports 15*b* and 15*c*.

The pressure of newly supplied, fresh and lower temperature refrigerant gas forces stagnant refrigerant gases, currently in both gaps $R_1$ and $R_2$, into the adjoining gaps and crank chamber C, after passing the clearances in the bearings 4*a*, 4*b* and 8. As a result, the stagnant gas is mixed with the fresh gas and the mixture circulates in the crank chamber C and the gaps $R_1$ and $R_2$. Accordingly, the individual bearings 4*a*, 4*b* and 8 are cooled and lubricated by a mist of lubricating oil suspended in the gas.

The refrigerant gas supplied into the first gap $R_1$ is also supplied to the sealed chamber $R_3$ via the bearing 4*a* to lubricate the seal 14. Because fresh refrigerant gas is, according to the present invention, liberally supplied to the anti-rotation mechanism K on its way to the suction chamber S from the crank chamber C, the inside of the mechanism K receives an adequate supply of lubrication. According to this embodiment, as explained above, the fresh refrigerant gas and lubricating oil are supplied to the individual bearings 4*a*, 4*b* and 8, the seal 14 and the anti-rotation mechanism K in such a way that these bearings and the seal undergo less wear and have improved durability.

The present invention is not limited to the above-described embodiment, and may be embodied in the following manners.

Figure 5:
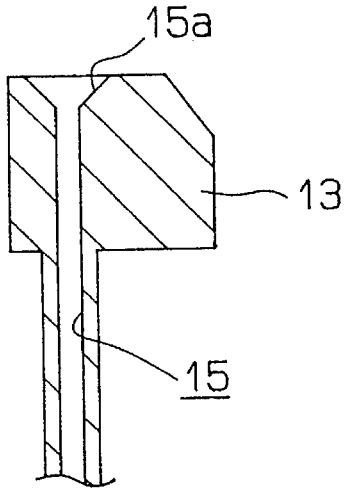
FIGS. 5 through 9 are partial cross-sectional views showing modifications of a balance weight and a gas supply passage in the compressor.

(1) As shown in FIG. 5, the inlet port 15*a* of the gas supply passage 15 in the balance weight 13 may be enlarged into a funnel shape. With this construction, it would be easier for the refrigerant gas to enter the passage 15, further improving the supply of lubrication to the individual bearings 4*a*, 4*b* and 8.

Figure 6:
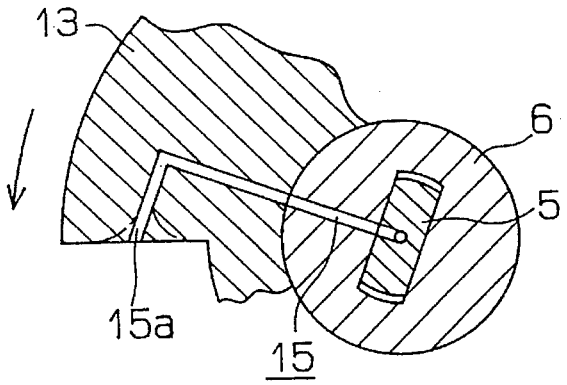

(2) As shown in FIG. 6, the inlet port 15*a* of the passage 15 may be formed in the forward end face of the balance weight 13 in the rotational direction thereof. It would be easier with this design for the refrigerant gas to enter the passage 15. This would also improve the supply of lubrication to the individual bearings 4*a*, 4*b* and 8. In this modification, the inlet port 15*a* may be enlarged to have a funnel shape as indicated by a chain line.

Figure 7:
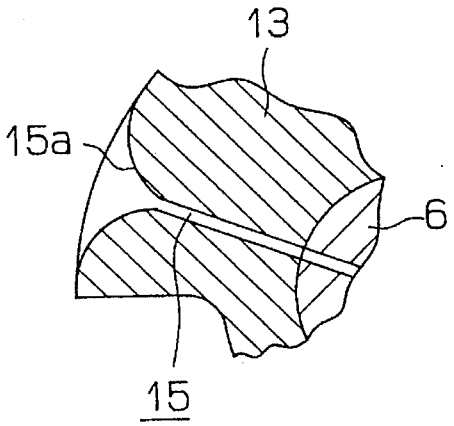

(3) As shown in FIG. 7, the inlet port 15*a* of the passage 15 is enlarged and tapered at the periphery of the balance weight 13. This makes it easier for refrigerant gas to enter the passage 15 thereby improving the supply of lubrication to the individual bearings 4*a*, 4*b* and 8.

Figure 8:
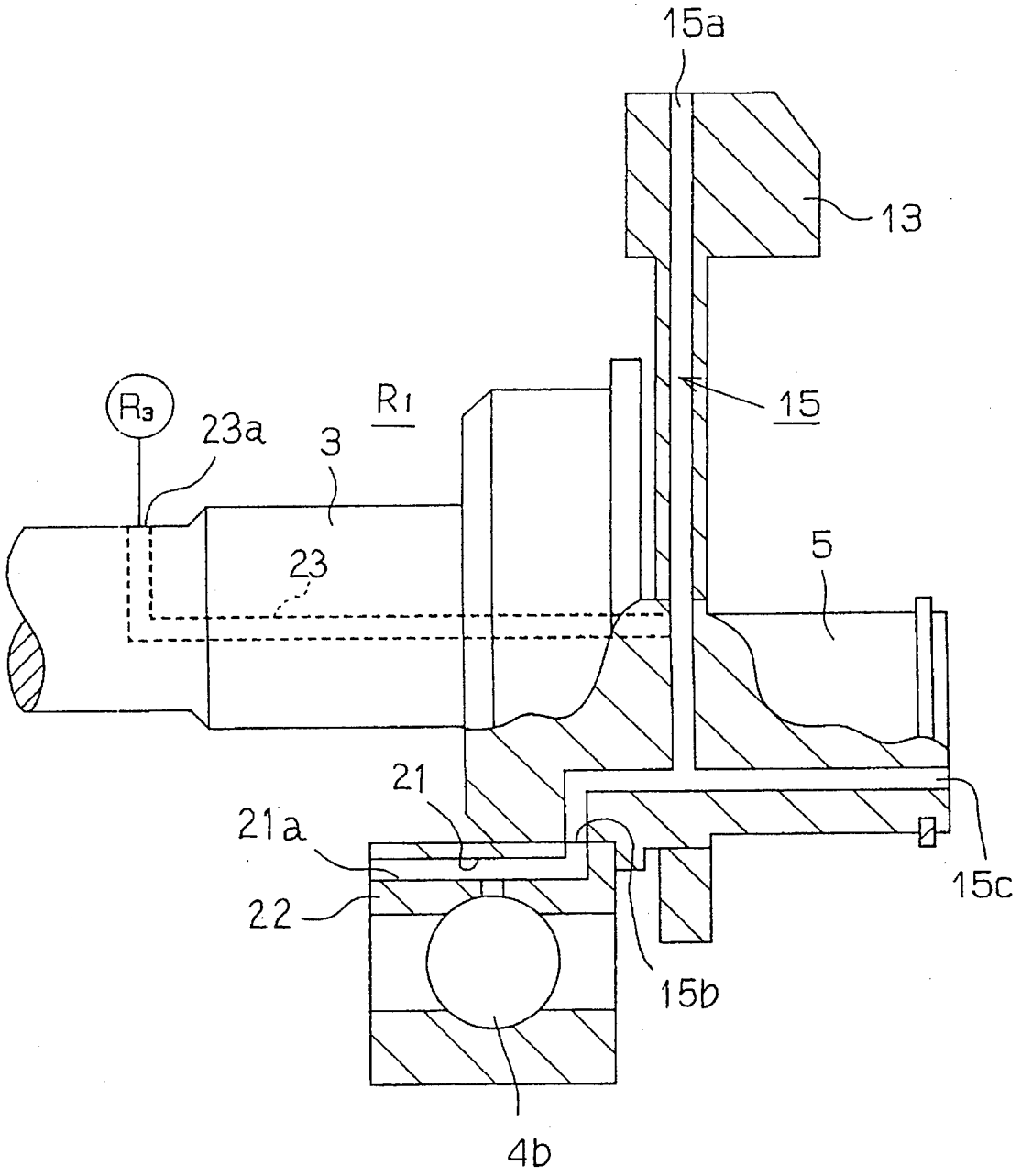

(4) In a further modification shown in FIG. 8, the outlet port 15*b* of the passage 15 on the first gap ($R_1$) side can be provided in the outer surface of the large-diameter portion of the rotary shaft 3. A subpassage 21 which communicates this outlet port 15*b* is formed in an inner race 22 of the radial bearing 4*b*. The subpassage 21 has an outlet port 21*a* open to the first gap $R_1$. Furthermore, a branch passage 23 extending along the axis of the rotary shaft 3 can be connected to the passage 15. This branch passage 23 has an outlet port 23*a* open to the seal chamber $R_3$. According to this design, it is possible to increase the amount of fresh refrigerant gas to be supplied to the first gap $R_1$ and to the seal chamber $R_3$.

Figure 9:
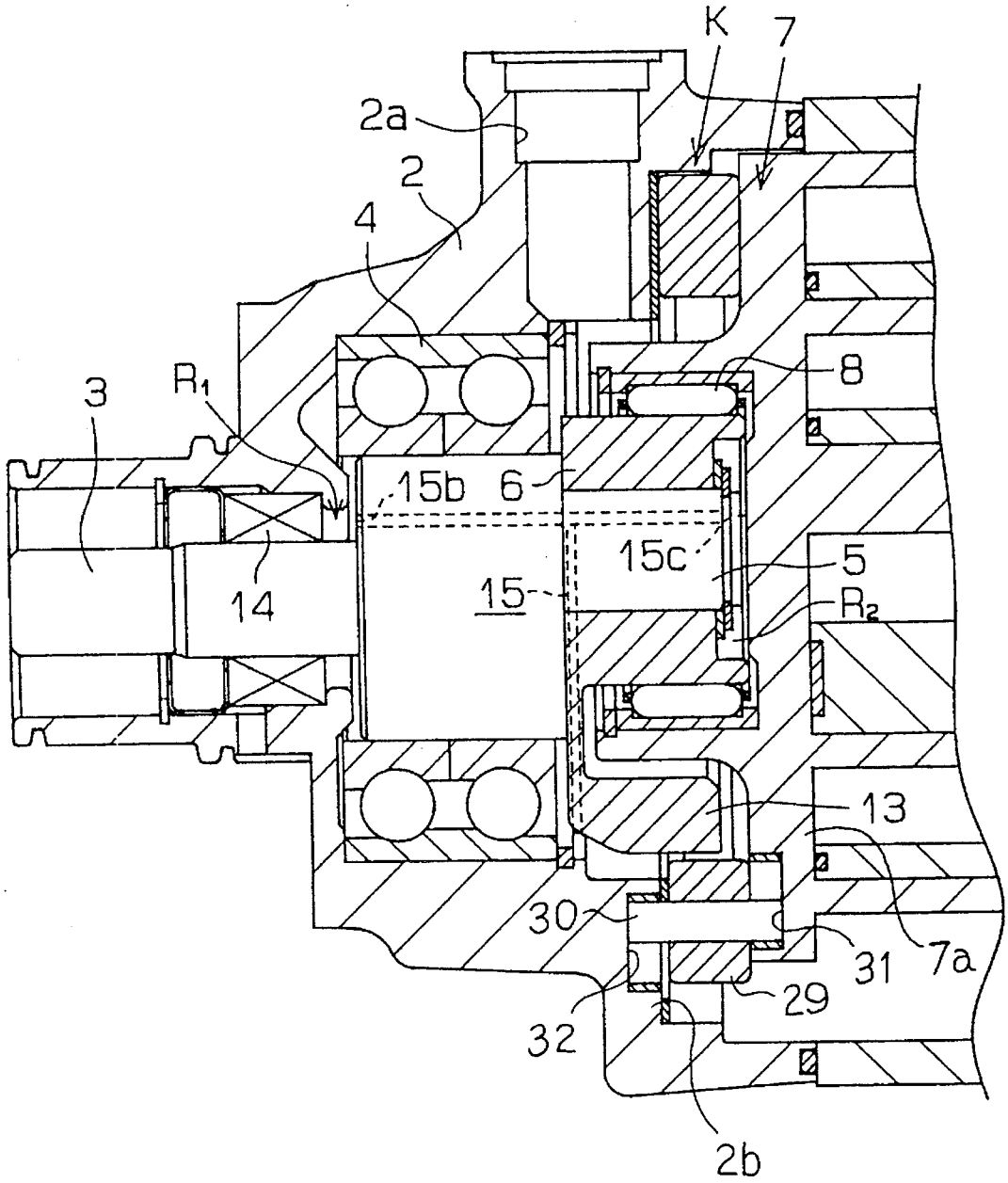
Figure 10:
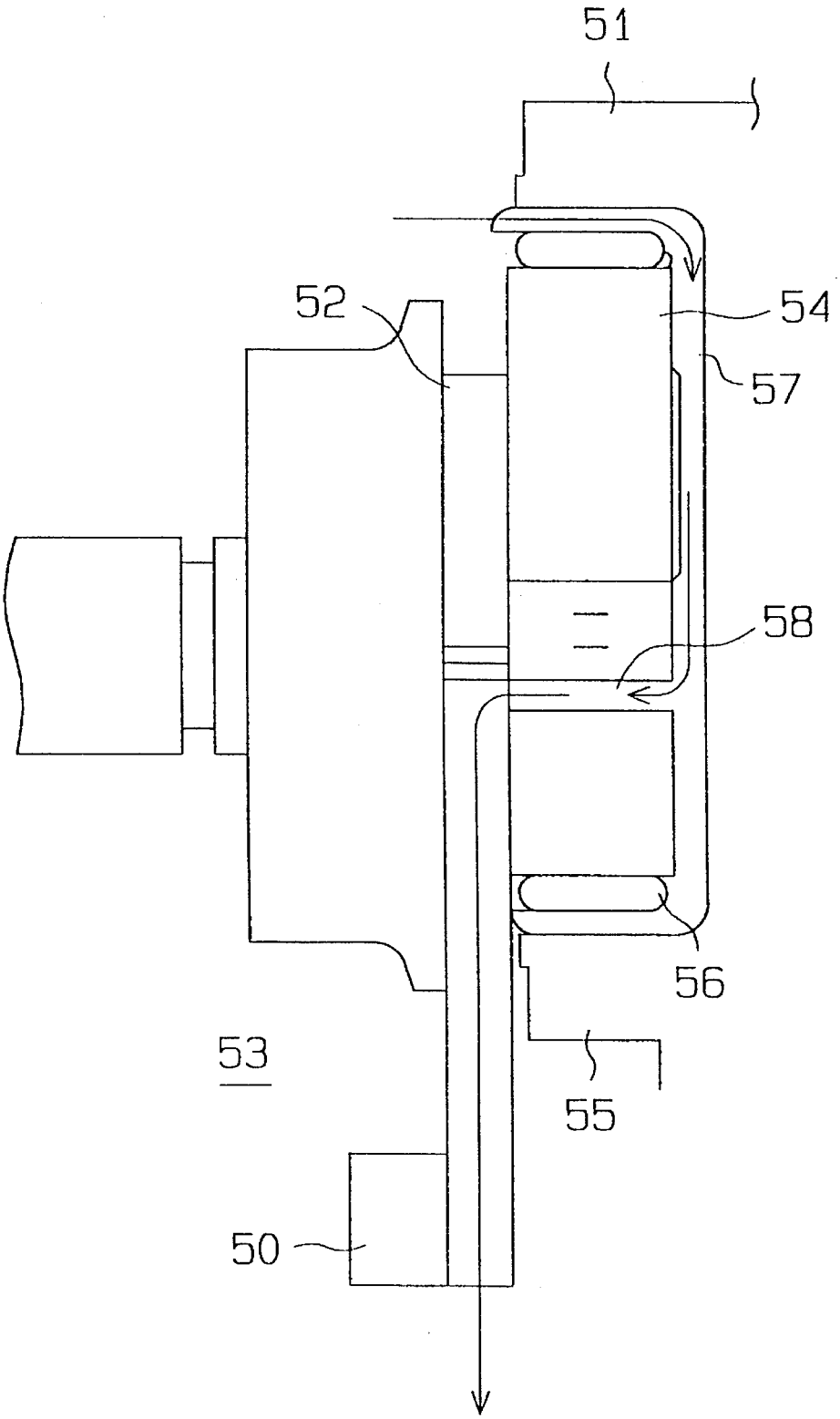
Fig.10 (Prior Art)
FIG. 10 is a cross-sectional view showing a conventional compressor.

(5) In a different modification of the compressor as shown in FIG. 9, the rotary shaft 3 is supported by a single large radial bearing 4 having a constant diameter in place of the pair of bearings 4*a* and 4*b* of different diameters. In this modification, the gap $R_1$ is formed between the radial bearing 4 and the seal 14. The outlet port 15*b* of the gas supply passage 15 is open to the gap $R_1$. This modification therefore has the same function and advantages as in the above-described embodiment. The anti-rotation mechanism K according to this modification, accommodates a plurality of pins 30 such that both ends of the pins 30 protrude from a movable ring 29 in loose engagement with a plurality of holes 31 and 32 respectively formed in the movable end plate 7*a* and the fixed pressure receiving wall 2*b*. This anti-rotation mechanism K therefore functions in the same way as in the above-described embodiment.

Therefore, the present examples and embodiments are to be considered as illustrative and not restrictive and the invention is not to be limited to the details given herein, but may be modified within the scope of the appended claims.

What is claimed is:

1. A scroll type compressor including a fixed scroll and a movable scroll, said movable scroll being connected to a rotary shaft by way of an eccentric shaft for performing an orbital movement around an axis of the rotary shaft without rotating about an axis thereof and opposed to the fixed scroll to define a plurality of compression chambers, wherein refrigerant gas containing lubricant oil is supplied to the compression chambers and compressed therein in accordance with the orbital movement of the movable scroll, said compressor comprising:

a first bearing portion rotatably supporting the rotary shaft, said first bearing portion defining a first gap with the rotary shaft;

a second bearing portion disposed between the movable scroll and the eccentric shaft for relative movement of the movable scroll and the eccentric shaft, said second bearing portion defining a second gap with the movable scroll;

a balance weight operatively connected to the movable scroll for maintaining dynamic balance of the movable scroll during the movement of the movable scroll;

a crank chamber for accommodating the balance weight, said crank chamber communicating with a suction port and receiving the refrigerant gas therefrom; and a passage extending through the balance weight, the eccentric shaft and the rotary shaft, for supplying the refrigerant gas to the first and second gaps from the suction port.

2. A compressor according to claim 1 further comprising:

said rotary shaft having a large diameter section, an intermediate diameter section and a small diameter section;

said first bearing portion including a pair of bearings for respectively supporting the large and intermediate diameter sections, each of said bearings having an outer race, an inner race, balls and a clearance defined between the outer race and the inner race; and said pair of bearings enclosing the first gap with the large and intermediate diameter sections.

3. A compressor according to claim 2 further comprising:

a sealing member disposed outside the first bearing portion for sealing the small diameter section;

said sealing member defining a third gap with the first bearing portion; and wherein the refrigerant gas supplied to the first gap is supplied to the third gap via the clearance within the pair of bearings.

4. A compressor according to claim 1, wherein said first bearing portion has a uniform outer diameter.

5. A compressor according to claim 3, wherein said passage includes an inlet capable of facing the suction port in accordance with movement of the balance weight and an outlet opening to the first and the second gaps.

6. A compressor according to claim 5, wherein said passage includes a first section having the inlet and extending radially with respect to the balance weight and a second section branched from the first section to respectively extend toward the first and the second gaps.

7. A compressor according to claim 6, wherein said second section extends along the longitudinal direction of the rotary shaft and the eccentric shaft.

8. A compressor according to claim 5, wherein said inlet is enlarged toward the suction port to have a funnel shape.

9. A compressor according to claim 5, wherein said inlet is enlarged along the periphery of the balance weight.

10. A compressor according to claim 3, wherein said balance weight has an end surface and said passage has an inlet on the end surface for introducing the refrigerant gas to the first and second gaps from the suction port when the balance weight is rotated.

11. A compressor according to claim 6, wherein said passage further includes a third section branched from the first section and opening in the peripheral surface of the rotary shaft toward the third gap.

12. A scroll type compressor including a fixed scroll and a movable scroll connected to a rotary shaft by way of an eccentric shaft for performing an orbital movement around an axis of the rotary shaft without rotating about an axis thereof and opposed to the fixed scroll to define a plurality of compression chambers, wherein refrigerant gas containing lubricant oil is supplied to the compression chambers and compressed therein in accordance with the orbital movement of the movable scroll, said compressor comprising:

a first bearing portion rotatably supporting the rotary shaft, said first bearing portion defining a first gap with the rotary shaft;

a second bearing portion disposed between the movable scroll and the eccentric shaft for relative movement of the movable scroll and the eccentric shaft, said second bearing portion defining a second gap with the movable scroll;

a balance weight operatively connected to the movable scroll for maintaining dynamic balance of the movable scroll during the movement of the movable scroll;

a crank chamber for accommodating the balance weight, said crank chamber communicating with a suction port and receiving the refrigerant gas therefrom; and a passage extending through the balance weight, the eccentric shaft and the rotary shaft, for supplying the refrigerant gas to the first and second gaps from the suction port, and said passage including a first section having an inlet capable of facing the suction port in accordance with movement of the balance weight and extending radially with respect to the balance weight and a second section branched from the first section to respectively extend toward the first and the second gaps.

13. A compressor according to claim 12 further comprising:

said rotary shaft having a large diameter section, an intermediate diameter section and a small diameter section;

said first bearing portion including a pair of bearings for respectively supporting the large and intermediate diameter sections, each of said bearings having an outer race, an inner race, balls and a clearance defined between the outer race and the inner race; and said pair of bearings enclosing the first gap with the large and intermediate diameter sections.

14. A compressor according to claim 13 further comprising:

a sealing member disposed outside the first bearing portion for sealing the small diameter section;

said sealing member defining a third gap with the first bearing portion; and wherein the refrigerant gas supplied to the first gap is supplied to the third gap via the clearance within the pair of bearings.

15. A compressor according to claim 12, wherein said first bearing portion has a uniform outer diameter.

* * * * *